United States Patent [19]

Saloff et al.

[11] Patent Number: 4,942,634

[45] Date of Patent: Jul. 24, 1990

[54] DAMPED FLUID DISPLACEMENT SUPPORT SYSTEM AND METHOD FOR MAKING THE SAME

[75] Inventors: William S. Saloff, Gloversville; David Saloff, Mount Kisco, both of N.Y.

[73] Assignee: Lumex, Inc., Bay Shore, N.Y.

[21] Appl. No.: 744,552

[22] PCT Filed: Aug. 31, 1983

[86] PCT No.: PCT/US83/01334

§ 371 Date: Apr. 29, 1985

§ 102(e) Date: Apr. 29, 1985

[87] PCT Pub. No.: WO85/00960

PCT Pub. Date: Mar. 14, 1985

[51] Int. Cl.[5] ..... A47C 27/08

[52] U.S. Cl. ..... 5/450; 5/451; 5/455

[58] Field of Search ..... 5/451, 452, 453, 456, 5/481, 455, 458, 472

[56] References Cited

U.S. PATENT DOCUMENTS

| | | | |
|---|---|---|---|
| 1,673,636 | 6/1928 | Perry | 5/458 X |
| 2,000,873 | 5/1935 | Arens | 5/458 X |
| 2,748,399 | 4/1956 | Rockoff . | |
| 3,251,075 | 2/1966 | Saltness . | |
| 3,585,356 | 6/1971 | Hall . | |
| 3,600,726 | 8/1971 | Williams . | |
| 3,611,455 | 10/1971 | Gottfried . | |
| 3,702,484 | 11/1972 | Tobinick . | |
| 3,736,604 | 6/1973 | Carson . | |
| 3,789,442 | 2/1974 | Tobinick . | |
| 3,810,265 | 5/1974 | McGrew . | |
| 3,872,525 | 3/1975 | Lea et al. . | |
| 4,141,770 | 2/1979 | Mollura | 5/458 X |
| 4,245,361 | 2/1981 | Evanson . | |
| 4,247,963 | 2/1981 | Reddi | 5/451 X |
| 4,370,768 | 1/1983 | Saloff . | |
| 4,479,275 | 10/1984 | Fraige | 5/451 X |
| 4,517,691 | 5/1985 | Phillips | 5/451 X |

FOREIGN PATENT DOCUMENTS

| | | | |
|---|---|---|---|
| 8500960 | 3/1985 | PCT Int'l Appl. | 5/451 |
| 608951 | 2/1979 | Switzerland . | |

*Primary Examiner*—Henry E. Raduazo
*Assistant Examiner*—Creighton Smith
*Attorney, Agent, or Firm*—Heslin & Rothenberg

[57] ABSTRACT

There is disclosed a substantially completely stable damped liquid displacement support system (11) which comprises an envelope of liquid impervious flexible material having panels (13) and (15) and provided with a valve (17), at least one interior divider (19) provided with a plurality of openings (25) and (27) disposed across the interior of the envelope separating the envelope into at least two compartments (21) and (23), each compartment containing a core (29) of resilient liquid absorbent material and a liquid substantially saturating the core. The opening (25) and (27) permit the liquid to migrate between the compartments (21) and (23) when pressure is applied to the system.

15 Claims, 4 Drawing Sheets

DAMPED FLUID DISPLACEMENT SUPPORT SYSTEM AND METHOD FOR MAKING THE SAME

BACKGROUND OF THE INVENTION

This invention relates to support systems. More particularly, the invention relates to support systems such as mattresses, cushions, upholstery padding and the like which have a liquid in them such as, for example, waterbeds.

Support systems which contain liquids, such as waterbeds and cushions and the various benefits thereof are well-known. On the other hand, such systems exhibit many disadvantages. For example, conventional waterbeds and cushions produce a kind of wave action or rolling motion when in use due to the tendency of the water or other liquid inside the system to rush rapidly from one part thereof to another when an individual places his weight thereon and forces the liquid to flow to another part of the system. Moreover, since the envelope containing the liquid in such a system is typically elastically yieldable, a reaction to the initial liquid surge occurs. This reaction results in a succession of countersurges within the envelope until the system reaches equilibrium. The described undamped surging and countersurging of the liquid in such systems is not only annoying to most individual users of such systems, but actually results in motion sickness in some of them. In order to obviate the above-mentioned disadvantages, many waterbed manufacturers do not employ liquid displacement in that portion of the system which is intended to support the head and shoulders of the user. Instead, they employ a section of mattressing constructed in the usual manner utilizing coil springs or other equivalent non-liquid structures. Obviously, this introduces an element of complexity to the manufacturing processes and, as well, increased costs.

Some manufacturers of waterbeds have attempted to dampen wave motion in various ways. For example, in U.S. Pat. No. 3,585,356 solid particles, such as styrofoam are disposed in the liquid for this purpose, while U.S. Pat. No. 3,600,726 discloses a therapeutic or comfort pad having a flexible film outer envelope filled with a fluid pervious foam material, water or other fluid being introduced thereto through a valve in the envelope. A flotation pad of somewhat similar construction is disclosed in U.S. Pat. No. 3,611,455. On the other hand, U.S. Pat. No. 3,736,604 discloses flap means, as illustrated in FIG. 11 thereof, for this purpose. In U.S. Pat. No. 4,245,361 there is disclosed a waterbed mattress having a sealed liquid enclosure made of a relatively stiff peripheral cushion of foam material having a central cavity which contains a resilient open-cell filling.

A pad having open-cell resilient foam material encased in and bonded to an impervious envelope provided with a valve for communication with the interior of the envelope to permit passage and containment of fluid is disclosed in U.S. Pat. No. 3,872,525 to provide a damped liquid displacement system. Another liquid displacement system is disclosed in U.S. Pat. No. 3,789,442 which shows a low liquid volume, low weight liquid or water pad for use as a mattress in which a lower cellular foamed material flexible pad is partially hollowed out for reception of a flexible material, liquid filled container, an unhollowed portion of the pad being provided for a user's head and upper body, which the liquid container does not rest on. An upper flexible pad of the same cellular foamed material extends across the lower pad. The entire structure described is contained within a flexible water impervious sheath, the structure being inserted through openings in the ends of the sheath which are subsequently closed. Another low-water volume, low-weight water pad for use as a mattress or cushion having a water-filled container sandwiched between upper and lower layers of cellular foam sheets all surrounded with a water impervious sheet is disclosed in U.S. Pat. No. 3,702,484.

U.S. Pat. No. 2,748,399, on the other hand, discloses a light-weight foam rubber cushioning structure in which a bag or chamber having a plurality of compartments, which may either communicate with or be isolated from one another, are filled with air. A layer of foam rubber is supported on the chamber, or the chamber may be sandwiched between two layers of foam rubber. In Swiss Pat. No. 608,951, there is shown a cushion structure which has an air-tight and water-tight inner sheath having a framework of plastic or elastic material, the sheath being filled with a liquid. The inner sheath is subdivided into multiple separate compartments which may be wholly isolated from each other or which may communicate with each other by way of orifaces or valves. The inner sheath is enclosed in an air-tight or water-tight outer casing which has a larger volume than the inner sheath and which also may be filled with a liquid or with air. Finally, U.S. Pat. No. 4,370,768 discloses a damped fluid displacement support system having an envelope of flexible material enclosing a core of resilient liquid-absorbent material which is substantially saturated with a liquid and which envelope may also include an interior divider to separate the envelope into two compartments.

While various of the above-mentioned references provide systems which ameliorate the wave action or rolling motion of the liquid contained therein to some extent in comparison to conventional systems, and while the last-mentioned reference, U.S. Pat. No. 4,370,768, provides a system which achieves such a result to an even greater extent than the others, there still exists a need for a system to overcome to an even greater extent the disadvantageous wave action or rolling motion in such systems.

Another disadvantage exhibited by conventional liquid displacement support systems is that they are relatively unstable in their tendency to react too rapidly in response to the application or shifting of any weight or force on them. For example, when an individual lying on such a system employed as a mattress attempts to roll over, the mattress yields rather quickly under him as he presses against it with one of his limbs to initiate movement. The mattress undulates under him as the liquid surges about within it. Also when the individual attempts to rise from the mattress, he has a strong feeling of instability with respect to his sense of balance or equilibrium, since the mattress rapidly gives way as his weight is shifted to its edge. This instability is also encountered when such liquid displacement support systems are utilized as cushions on a conventional chair, a wheelchair, or on the seat of an automobile. The instability is manifested very clearly in such instances when an individual attempts to rise from a conventional chair or a wheelchair, or to alight from an automobile. What actually occurs is that the liquid is quickly displaced within the cushion as an individual's weight is shifted and he has the feeling that the cushion is squirting out from under him as he attempts to thrust his body upwardly. Furthermore, the normal rocking motion of a moving automobile or wheelchair is greatly amplified by conventional liquid filling cushion systems for the same reasons. Once again, while various of the above-mentioned references provide systems which alleviate this disadvantage, that is the relative instability in response to the application of force or weight thereto, to some extent and U.S. Pat. No. 4,370,368 achieves such a result to an even greater extent than various of the other references discussed above, there still exists the need for a system to overcome this instability to an even greater extent.

Another disadvantage associated with conventional liquid displacement support systems is the requirement of such systems to be utilized for the most part in a horizontal disposition. This is so because if a relatively elongated liquid displacement support system or unit is disposed vertically, or at some considerable angle to the horizontal, the liquid will be drawn by gravity to the lower portions. This causes bulging in these areas while substantially lowering or substantially completely eliminating the cushioning and supporting effects in the upper areas. Consequently, such systems are of only limited usefulness as backrests or upholstery padding or in hospital beds, for example, where a portion of the bed needs to be tilted at an angle to the horizontal. U.S. Pat. No. 4,370,678 recognizes this problem and while it alleviates it to some extent by providing a system in which a reduced amount of liquid is employed, the movement of which is damped and modulated by employing a core of flexible cellular material which is substantially completely saturated by the liquid, there still exists a need for providing liquid displacement support systems which exhibit even greater improvement in this respect no matter what their spatial disposition may be.

A still further disadvantage of conventional liquid displacement support systems resides in the fact that most utilize non-compressible, or at most only slightly compressible liquids, such as water, and they are provided with flat planar surfaces with which the body of a user comes into direct contact. Thus, the skeletal protuberances, particularly those such as the pelvis and hip bones, the coccyx, the spinal vertebra, the shoulder blades, the elbows, the knees and the ankle bones, of the body of an individual using such systems come into direct contact with the planar surfaces thereof. Thus, discomfort results to the user due to the force of the action of such bony protuberances against the planar surfaces of the systems and the consequent force of the reaction of the liquids in such systems to such force. This disadvantage is particularly troublesome in situations where such systems are utilized, for example, as cushions or wheelchairs where an incapacitated individual must remain seated thereon for extended periods of time or in hospital beds where an individual user may have to remain substantially immobile for extended periods or have only limited capacity for movement. The same is also true, however, in situations where the systems are employed as cushions in an automobile and the user must remain in substantially one position for extended periods. While various of the above-mentioned references alleviate this problem somewhat by the utilization of cushioning means, such as foam padding, there still exists the need for systems which obviate this problem to an even greater extent.

A still further disadvantage of conventional liquid displacement support systems is their weight. Since substantially the entire interior of the liquid cell is filled with liquid, its overall weight is considerable. Again, while various of the above-mentioned references overcome this problem to some extent, there still exists a need for systems which further ameliorate this disadvantage to an even greater extent.

From the above discussion it is evident that while liquid displacement support systems have evolved to a point where the many disadvantages of the earlier systems have been overcome to some extent, such systems still exhibit the above-mentioned disadvantages and a need still exists for the provision of liquid displacement support systems which do not exhibit the same. The present invention fulfills this need.

BRIEF STATEMENT OF THE INVENTION

In accordance with the invention and the broadest aspect thereof, there is provided a damped liquid displacement support system which comprises an envelope of flexible material, a core of resilient liquid-absorbent material occupying substantially all of the space within the envelope, a liquid substantially saturating the core, a valve mounted in the envelope for communication between the interior thereof and its ambience for admitting and discharging liquids and gases, and at least one interior divider provided with a plurality of openings disposed across the interior of the envelope and separating it into at least two compartments each containing its own individual liquid-saturated core, and the openings in the interior divider permitting the liquid to migrate between the compartments of the envelope when pressure or force is applied thereto.

In another embodiment of the invention the described system includes a plurality of aligned openings disposed in the envelope and the interior divider with the peripheral edges of the aligned openings joined together at substantially zero height, or inserting tubular means through these openings and sealing the peripheral edges thereof to the tubular means at a distance spaced apart from each other to prevent any external migration of liquid from the envelope while stabilizing the amount of liquid in the envelope. In a further variation of this embodiment of the invention wherein tubular means are employed, the aligned openings or holes in the interior divider are larger than those of the envelope and the peripheral edges of the openings of the envelope only are sealed to the tubular means in a spaced relationship, the larger openings in the interior divider thus providing additional openings for liquid to migrate between the compartments.

In accordance with the invention there is also provided a method for making a damped fluid or liquid displacement support system by placing at least two cores of liquid-absorbent material in an unsealed envelope of liquid impervious material, the cores substantially filling the envelope, disposing at least one interior divider provided with a plurality of openings across the interior of the envelope and between the cores and separating the envelope into at least two compartments each of which contains its own core and which communicate with each other through the openings in the interior divider, compressing the envelope and the cores and forcing substantially all the gases therefrom, sealing the divider and the envelope to each other around their peripheral edges, submerging the compressed envelope and cores in a liquid and partially opening the envelope to admit the liquid thereto until the cores are substantially saturated with the liquid and will absorb no more thereof, and closing the envelope.

In another embodiment of the invention, the described method includes forming a plurality of aligned openings in the envelope and the interior divider and sealing the edges of the aligned openings together at substantially zero height, or inserting tubular means through these openings and sealing the peripheral edges thereof to the tubular means at a distance spaced apart from each other. In a further variation of this embodiment of the invention, the method also includes, where tubular means are employed, forming aligned openings or holes in the interior divider of greater dimensions than those of the envelope and sealing the peripheral edges of the openings of the envelope only to the tubular means in a spaced relationship and providing additional openings for liquid to migrate between the compartments.

THE DRAWINGS

In order to understand the invention more fully reference is directed to the accompanying drawings which are to be taken in conjunction with the detailed description of the invention as set forth hereinafter. In the drawings, FIG. 1 is a plan view, partially in section, of a damped fluid or liquid support system according to the invention illustrating the relationship of various parts thereof to each other and the disposition of the openings in the interior divider to permit liquid to migrate between the compartments thereof;

Figure 2:
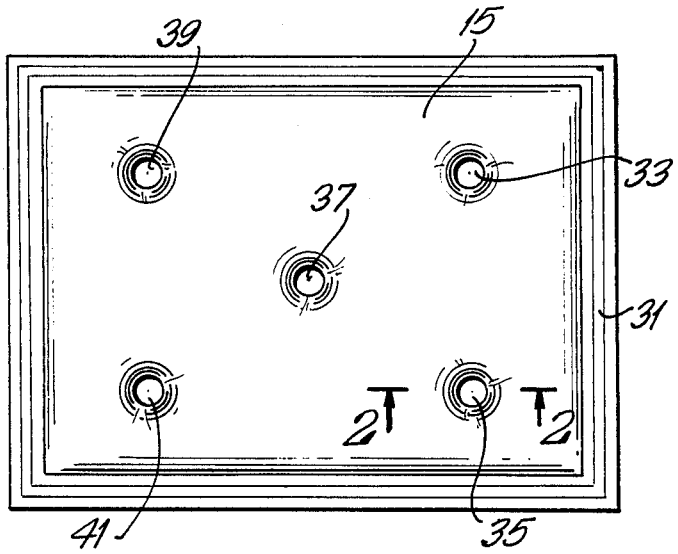
FIG. 2 is a plan view of another embodiment of a damped liquid support system according to the invention illustrating the utilization of the aligned openings through the envelope and interior divider thereof.
Figure 3:
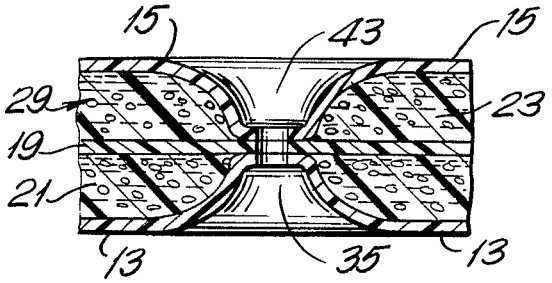
FIG. 3 is a partial cross-sectional view in elevation taken across line 2—2 of the system shown in FIG. 2 illustrating the joining of the peripheral edges of an aligned opening through the envelope and the interior divider at substantially zero height.
Figure 4:
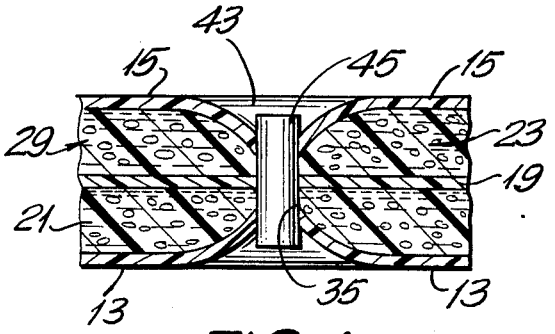
FIG. 4 is a partial cross-sectional view in elevation taken across line 2—2 of the system shown in FIG. 2 illustrating the utilization of tubular means disposed in an aligned opening through the envelope and the interior divider and showing the joining of the peripheral edges of the aligned opening of the envelope and interior divider to the tubular means in a spaced apart relationship.
Figure 6:
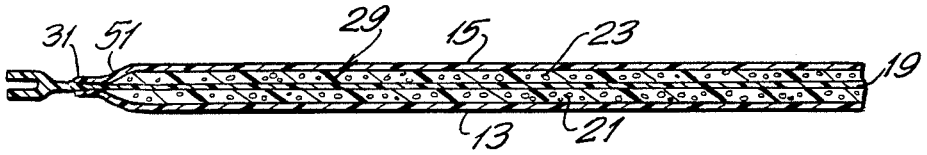
FIG. 6 is a partial elevational view in cross-section illustrating the configuration of a damped liquid displacement system according to the invention in a compressed and sealed state.
Figure 7:
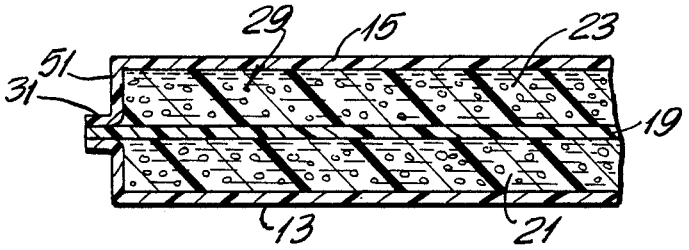
Figure 8:
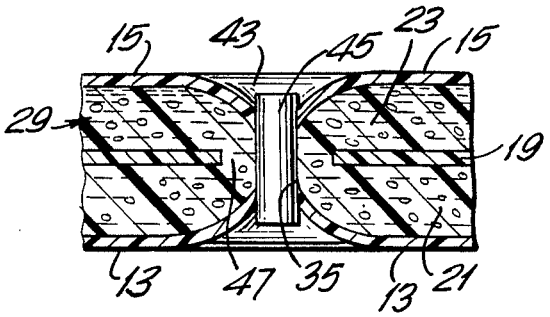

FIG. 7 is a partial elevational view in cross-section of the system illustrated in FIG. 6 after the core has been substantially saturated with a liquid; and FIG. 8 is an elevational view in cross section taken across line 2—2 of FIG. 2 of a damped liquid displacement support system according to the invention, illustrating the use of aligned openings in which the peripheral edges of the aligned openings of the envelope only are attached to the tubular means in a spaced relationship and the aligned opening in the interior divider is larger in size than the openings of the envelope and is not attached to the tubular means.

DESCRIPTION OF THE PREFERRED EMBODIMENTS

Figure 1:
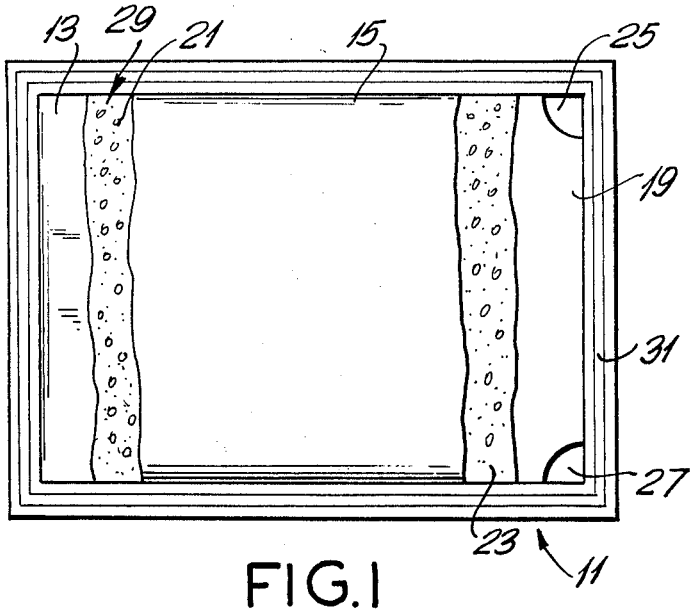

Referring now to FIG. 1 there is shown a damped liquid displacement support system according to the invention comprising a liquid impervious envelope or cell 11, including panels or sides 13 and 15. The envelope is preferably made of a high quality "pool grade vinyl" and has a thickness of about 0.020 inch, being free of pinholes and having a cold crack resistance of at least about minus 20° F. (Ca 30° C.) and which has properties that permit the panels or sides from which it is constructed to be readily fused together by standard dielectric heating techniques. A valve 17 is sealed in panel 15 of the envelope, as shown more particularly in FIG. 5, permitting communication between the interior of the envelope and its ambience in order to admit and discharge liquids and gases. The valve is preferably of the positive closing type and in this respect it has been found that Type 1020 AF manufactured by Halkey-Roberts is eminently suitable for this purpose. An interior divider 19, made of the same or similar material as panels 13 and 15, is disposed across the interior of the envelope and separates it into two compartments 21 and 23. The interior divider is provided with four openings, such as the two arc-shaped openings designated by numerals 25 and 27, thus permitting communication between the compartments. While the openings in an interior divider employed in a system according to the invention are usually located at the corners when the system has a generally rectangular configuration, it is to be understood that they may be greater than four in number and are preferably located along or in the vicinity of the peripheral edges of the divider. For example, should the system have a circular configuration a plurality of such openings may be located around or in the vicinity of the circular periphery of the divider. While the shape of such openings is not critical, the size and location thereof provide highly beneficial effects in a damped liquid displacement support system according to the invention as explained more fully hereinafter.

A core 29 of resilient liquid-absorbent material occupies substantially all of the space within the compartments of the envelope. A liquid such as water or other suitable liquid, substantially saturating the core is also contained in the compartments of the envelope. The core 29 may be made of urethane foam or any other suitable resilient, liquid-absorbent material. Material such as urethane having a cellular structure is particularly useful because it will provide a desirable damping action, as explained more fully hereinafter. The resilient liquid-absorbent cone 29 may be adhesively attached with a suitable adhesive, such as that described below, to the interior divider 19 only, on either one or both sides thereof, or to one or both panels 13 and 15 of the envelope as well, the adhesive being applied for this purpose to the panels on the sides thereof which serve as their internal surfaces. It will be appreciated that the panels of the envelope, as well as the interior divider, which lies across the interior of the envelope in a coplanar relationship with respect to side panels 13 and 15 thereof, are of sufficient dimensions to accommodate the core in its liquid-saturated, expanded condition and to permit heat sealing of the panels and divider to each other along their peripheries as shown at 31.

While the operation of the system generally bears some similarity to the operation of a conventional waterbed or cushion or other fluid displacement support device, it operates in a manner clearly different from such conventional systems and exhibits heretofore unachieved benefits. The similarity of operation involves the fact that the fluid, in this case water, is forced to migrate from one portion of the compartments to another as force or weight is applied to the system. However, the similarity with the operation of a conventional waterbed or cushion and other known fluid displacement support devices ends at this point and the present system exhibits vital differences due to is unique construction. For example, in the present device, the water or other liquid is not permitted to migrate freely from the region where pressure is applied to the compartments of the envelope or cell of the system, yet it is permitted to flow in a modulated, throttled or controlled manner between the compartments by way of the openings in the interior divider, such opernings being sized to provide the most desirable flow rate of the water or other fluid between the compartments. Furthermore, the movement of the water or other fluid is, at the same time, modulated or throttled by the cellular structure of the core which also provides a measure of firmness to the system due to its resilience. In addition, it will be appreciated that in the present system the amount of water or other fluid to be displaced is far less than the amount employed in a conventional system.

Consequently, the fluid or liquid displacement support system of this invention, as described, exhibits substantially complete stability and no matter what the spatial disposition may be, this stability remains substantially unchanged without any evidence of undue bulging at the bottom when it is employed in a relatively vertical plane. The substantially complete stability and absence of undue bulging, heretofore not satifactorily achieved in known liquid displacement support systems, is due not only to the fact that the interior of the envelope or cell 11 is substantially evacuated prior to saturation of the core, thus forming a vacuum in the cell if the fluid migrates downwardly, but primarily to the fact that the fluid is permitted to flow in a modulated, throttled controlled manner out of and into the compartments, through the openings in the interior divider and, as well, to the fact that the core is prevented from shifing to any appreciable extent, especially where the core material is adhesively attached to the interior divider and/or the panels of the envelope. Thus, the system constantly seeks equilibrium in a slow and controlled manner when a force or weight is applied thereto and wave action or surging and countersurging rolling motion is eliminated.

As a practical matter, thereofore, when an individual uses a system constructed in accordance with the invention as a bed or a cushion, the adjustment of the system to his weight is slow and gradual, being almost imperceptible. However, since the liquid is permitted to flow and constantly seeks equilibrium, for a few moments, the individual gradually feels an increasingly comfortable sense of firm support. Should he attempt to maneuver his body, from one position to another, or to stand, he has continuous support from the system because of its slow reaction time to his movements. This imparts a feeling of stability to the user as compared to the usual feeling of instability associated with conventional systems which make it difficult for individuals such as a patient, for example, to perform basic tasks, such as eating, scratching, dressing and the like and actually produce motion sickness and even disorientation or hallucination in some individuals. Moreover, he no longer feels that the system is squirting out from under him, when he attempts to thrust his body upwardly, as he rises. Furthermore, when an individual employs a system in accordance with this invention as a bed or a cushion, and particularly as the latter, the fluid or liquid therein, as his body comes into contact with the system, will have a greater tendency to move towards the peripheral edges of the envelope or cell 11 and slowly flow through the openings rather than a relatively pronounced upward flow since the openings in the interior divider are loated along the periphery thereof and permit the liquid to flow between the compartments in a slow, modulated or throttled and controlled manner.

Still further, it is to be noted that when a person uses the system of this invention certain pressure points are normally developed corresponding to prominent features, particularly the boney protuberances, on his body. Now, it is a medical fact that while pressure reduction through broader weight distribution is achieved by the present invention, such broader weight distribution is not by itself the ultimate solution to overcoming the disadvantages of the development of these pressure points. Even when sitting or lying on a flotation system capable of reducing pressure dramatically, many individuals suffer discomfort to some degree due to just the normal protrusion of the Ischial tuberosities or the coccyx, or the application of even the slightest pressure to areas sensitized by injury or skin trauma. Furthermore, injured or traumatized areas will also heal much more rapidly if there is no applied external pressure to restrict the blood circulation. This problem or condition is obviated according to this invention in the embodiments thereof illustrated in FIGS. 2 through 4 and 8 by constructing an envelope or cell as previously described and, in addition, providing holes or compressed areas under each bone and/or sensitive area in a manner that will support all of the body weight in flotation around the sensitive areas while suspending those areas to eliminate contact with any part of the cell or a base or pad on which it rests, thus preventing any pressure from being applied to them. By eliminating contact at the areas mentioned, pressure on the remaining body areas resting on the envelope or cell will increase somewhat. However, due to the capability of the basic envelope or cell to distribute pressure, it will still be well below medically acceptable tolerances. To exercise this conceptual aspect of the invention and at the same time achieve maximum benefits thereof to an individual user, such as a medical patient or the like, for example, consideration must be given to the fact that no two individuals are exactly alike in weight, bone structure and other physical attributes and, as well, specific areas of injury, skin trauma and the like will vary in size and location. Therefore, particularly in the area of medical use, it is desireable for the holes or compressed areas of the envelope or cell to be located and sized so that pressure on the areas of sensitivity or injury is eliminated. In accordance with the present invention, this may be achieved by making a model, form or accurate impression of an individual's body geography in a block of any of the materials currently in use for making impressions in order to accurately locate and size the holes or compressions in the envelope or cell. In such a mold forming procedure, areas of sensitivity or injury which make no impression in the mold or impression material may simply be marked with a felt marker or otherwise so that those areas of the envelope or cell may also be compressed as needed to provide flotation of the areas of sensitivity or injury, that is, to provide compressions or holes to the areas of sensitivity or injury.

The mold or form so made can then be employed as a pattern or mold from which the base or pad, previously mentioned above, can be made, thus providing the ultimate in pressure relief for the entire body of a subject or patient. The block or mold can be either hardened or duplicated in a hard material and employed as a base or pad for the cell or envelope. When such a mold or form is used as a base for a damped liquid displacement support system according to this invention, it provides the added benefit of aligning an individual, such as a patient, for example, in the proper position in relation to the holes, or in relation to the seat of a wheelchair or bed in which the system is placed.

It will be appreciated that for purposes of general use the compressed areas can be located and made to a size so that they will relieve pressure at the Ischials and coccyx in order to provide better comfort generally for any body structure, such as, for example, the application thereof to upholstered furniture, vehicle seats, padded wheelchairs and the like. It is also to be noted that holes, that is small openings, may be provided through the envelope or cell which form slight depressions, thereby providing tufting effects in upholstered furniture, as well as acting as means to further secure the system to the furniture structure, particularly when installed in a vertical position as a flotation backrest. Thus the system is prevented from shifting or becoming deformed due to vibration or abuse, coupled with normal gravitational effects.

It is to be noted further that no matter what particular embodiment a system of this invention takes in its completed form, specific areas of the envelope or cell may be substantially completely compressed. For example, where the structure is employed as a mattress, cushion, backrest, or other upholstery item on furniture and certain areas thereof are not required to perform a supporting function, those areas of the structure may be compressed substantially completely to zero height and heat sealed in the same manner as the panels of the envelope and interior divider are joined along their peripheral edges. In other words, areas of the structure which do not require flotation may be closed off substantially completely. A benefit derived from closing off such areas is that it provides increased flotation in the balance of the envelope or cell, thus eliminating the possible need, in certain applications, to increase the overall height of the envelope or cell and avoiding unnecessary additional weight while maintaining minimal size.

Turning now more particularly to FIGS. 2 through 4 and 8, there is shown in FIG. 2, a system like that of FIG. 1 except that the envelope or cell 11 is provided with a plurality of holes or openings 33, 35, 37, 39 and 41. It will be appreciated that the openings form compressed or depressed areas, as shown by area 43 in FIG. 3, in the system and as previously described above. As may further be seen from FIG. 3, panels 13 and 15 of the envelope and the interior divider 19 may all be heat sealed together at substantially zero height to form a hole or opening which is sealed around the peripheral edges thereof to prevent any external flow of fluid or liquid from the system. On the other hand, in a modification of this embodiment, the holes or openings may be provided with a tubular means 45. As shown more precisely, for example, in FIG. 4, hole or opening 35 is provided with tubular means 45 and panels 13 and 15 of the envelope as well as interior divider 19, are sealed to the tubular means around the peripheral edges of the openings therein in a spaced relationship with respect to each other, thus creating a shallower or less pronounced compressed or depressed area. Utilization of the tubular means in a system according to the invention provide a system which has specific height attributes and which can be adjusted as needed or desired by employing tubular means of different lengths.

In a still further modification of the embodiment of this invention as illustrated in FIGS. 2 through 4 and 8, there is shown more precisely in FIG. 8 a hole or opening 35 provided with tubular means 45 having panels 13 and 15 of the envelope sealed to the tubular means in spaced relationship around the peripheral edges of the openings therein. In contrast, however, the hole or opening in the interior divider 19 is of larger dimensions than those in panels 13 and 15 and is not attached to the tubular means, thus providing an additonal hole or opening 47 for communication between the compartments of the system.

Figure 5:
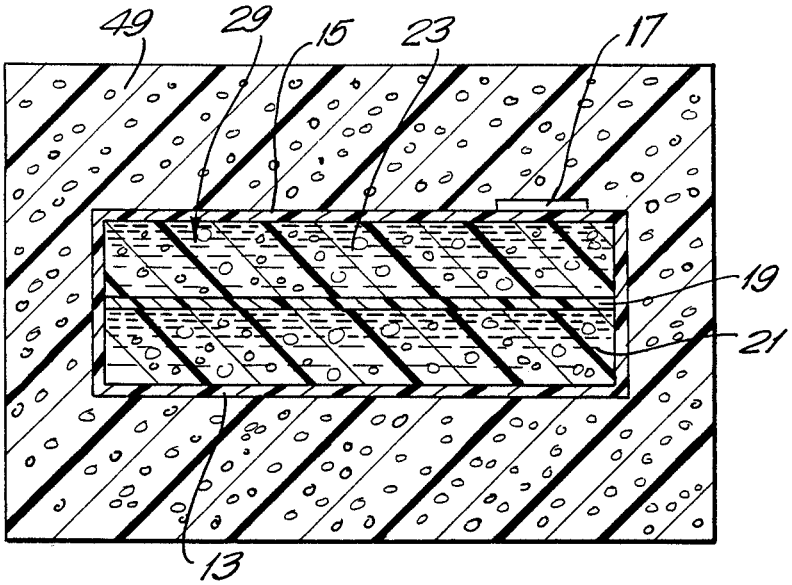
FIG. 5 is an elevational view in cross-section of a damped liquid displacement support system according to the invention illustrating the use of a relatively thick casing of resilient material surrounding the envelope.

In accordance with this invention the damped liquid displacement support system and the various embodiments thereof as set forth above may be use in the described form as final products. In general, however, it is preferred that the previously described envelope or cell be disposed in an outer casing of resilient material having the properties of a good thermal insulator, as shown more particularly in FIG. 5. Referring now to FIG. 5 such a system is shown there in a configuration which would be useful as a mattress. A suitable outer casing 49 of resilient material which exhibits good thermal insulating properties surrounds the envelope or cell 11. Urethane foam is very suitable for this purpose. Although not shown, it will be appreciated that casing 49 may be covered with any suitable covering material generally used for mattresses so long as it is sufficiently soft and has enough stretchability so as not to restrict the action of the system described hereinabove. The casing 49 is provided with a suitable cavity to accept the envelope or cell 11 and may be fabricated in halves in order to facilitate the assembly of the system. In a preferred embodiment of this invention, a suitable glue is employed to adhere envelope or cell 11 to the inner surface of the casing 49. The glue should be of a type suitable for bonding a vinyl to foam such as Scotch-Grip Brand Adhesive Number 1359, manufactured by the 3-M Company. The bonding of the envelope or cell 11 to the casing in this manner serves to keep it in place during its shipment or manipulation. It also further aids in resisting or reinforces against the natural tendency of the envelope or cell to bulge near the bottom when it is stood on end, although in this latter respect the cell is substantially completely stable and free of bulging as described above.

As previously mentioned, a liquid such as water or other suitable liquid or fluid substantially saturates the core in a damped fluid or liquid displacement support system in accordance with this invention. Water is the preferred liquid employed in the practice of the invention. In this respect, however, since the inventive system in actual use may be subjected to relatively low temperatures and temperatures even as low as subzero temperatures, it is preferred that the water be employed with additives which lower its freezing point. A particularly preferred liquid which may be employed in the practice of this invention is, therefore, a liquid comprising 20%, propylene glycol, 4% Natrosol and further additives, the remainder being water. Such a mixture is not affected by great temperature changes and the presence of the propylene glycol acts as an antifreeze. In addition, propylene glycol and Natrosol provide a further advantage in that they increase the viscosity of the liquid, such as water, thereby effecting further control over the movement of the liquid and obviate a tendency for a certain amount of the liquid to always remain in the most compressed area or areas of the system. This further improves the stabilizing, supportive, controlled nature of the flotation achieved by the system. Natrosol is a registered trademark of Hercules Powder Company, Wilmington, Del., U.S.A. for an alkali-soluble cellulose ether.

With respect to fluids or liquids which might be employed in the practice of this invention it is to be noted that the use of thick gells of various formulations including petroleums, while they are useful, should generally be avoided for a number of reasons. For example, such materials are relatively heavy and do become firmer with time, losing their ability to distribute weight and to reduce pressure. Furthermore, those materials are generally expensive. In contrast, water is readily available and inexpensive even when employed as mixtures with propylene glycol, Natrosol and other additives.

A damped liquid or fluid displacement support system in accordance with this invention obviates all of the disadvantages of previously known conventional systems as mentioned above and in this respect, since many of the previously known systems require a relatively deep amount of liquid in order to support body weight particularly without the fluid being completeely displaced by the weight, thus causing bottoming out, the overall weight of such systems is considerably greater than a system in accordance with the present invention since the presence of the core material in the instant system considerably decreases the amount of water needed in order to substantially completely saturate the core and provide the necessary weight distributing properties which are achieved by the damped liquid or fluid displacement support system of this invention.

While overcoming the various disadvantages of conventional fluid displacement support systems, a system in accordance with the instant invention is also advantageous in that it might be employed in a wide variety of end products. For example, the instant system may be manufactured in a wide variety of shapes and can be employed as a mattress, as a cushion for use in padded wheelchairs or automobiles, or on conventional chairs, and also may be employed as upholstery paddings on furniture items, for example, as flotation backrests on chairs, as well as flotation armrests. In the area of office furniture, manufacturers are constantly striving to make their chairs more conforming to the backs of the users and the ways to make the necessary adjustments to achieve the desired result more facile and workable. Moreover, the time required to make the desired adjustments is also considerd to be critical. The damped liquid displacement support system of this invention, however, eliminates these problems since it is automatically self-adjusting and leveling. It will be appreciated that a system in accordance with the invention, due to its unique construction, may be suitably shaped for utilization as upholstery padding in furniture items, replacing conventional padding in all respectes whether such items are being utilized for business, domestic or medical uses.

It is to be understood that it is within the purview of this invention to employ different substances for the core, as well as for the liquid medium, as previously mentioned above, contained therein. Similarly, a casing made of different material may be employed to surround the envelope or cell. It is to be noted, however, that no matter what particular materials are employed to form the casing, or what particular fluids are utilized in the envelope or cell, they should be chosen so that they will not substantially alter the properties of the final product to the extent that they detract from the required degree of firmness or stability of a system such as described above. For example, in this respect the liquid medium, as well as the material employed for the core, should not appreciably result in great variations in reaction time and degree of firmness and stability produced by the invention.

THE METHOD

In accordance with the invention there is provided a method for making a damped fluid displacement support system which comprises in its broadest aspects placing at least two cores of resilient liquid-absorbent material within an unsealed envelope of liquid impervious material, the cores substantially filling the envelope, disposing of at least one interior divider provided with a plurality of openings across the interior of the envelope and between the cores and separating the envelope into at least two compartments each of which contains its own core and which communicate with each other through the openings in the interior divider, compressing the envelope and the cores and forcing substantially all the gases therefrom, sealing the divider and the envelope to each other around their peripheral edges, submerging the compressed envelope and cores in a liquid and partially opening the envelope to admit the liquid thereto until the cores are substantially saturated therewith and will absorb no more thereof, and closing the envelope. The sealing step may be carried out either before or simultaneously with the compressing step. The method preferably also includes surrounding the envelope with a casing and adhesively attaching the casing, which is preferably made of a resilient foam material having good thermal insulating properties, and the envelope to each other.

In addition, the method also includes the forming of a plurality of aligned openings in the envelope and the interior divider and sealing the peripheral edges of the openings together. The peripheral edges of the aligned openings may be sealed together at substantially zero height or a tubular means may be inserted through the aligned openings and the peripheral edges of the openings sealed to the tubular means at a distance spaced apart from each other. In those instances where the aligned openings are sealed together at substantially zero height or they are sealed to a tubular means inserted therethrough in spaced relationship, the formation and sealing thereof may be accomplished before the compression step or similtaneously therewith.

In accordance with one aspect of the inventive method the aligned openings in the interior divider are made larger in size than the openings in the panels of the envelope or cell and only the peripheral edges of the envelope panel openings are to be sealed to a tubular means inserted through the openings. In accordance with this aspect, the larger holes are pre-cut in a convenient manner, first, in the cellular core material which is then adhesively attached to the interior divider, and then cut in the interior divider. After this operation is completed, the holes or openings are then made in the panels of the envelope, the panels and interior divider with its adhered core material are then assembled, and the tubular member then inserted through them. The assembly is then placed in a suitable die, compressed and heat sealed, thus closing the assembly around its peripheral edges and also sealing the peripheral edges of the openings in the panels of the envelope to the tubular means while forming an opening in the interior divider through which the tubular means passes. It will be appreciated that in accordance with this particular aspect of the inventive method the peripheral openings in the interior divider are not sealed to the tubular means. Once again the assembly may be sealed either before or simultaneously with the compression step.

More specifically, the fabrication of a system in accordance with this invention can be carried out by using standard heat sealing die tooling with certain modification which involves packing the die with a foam rubber or sponge material having a firmness at least twice that of the core material, so that the core material will be compressed when the die is actuated and substantially all of the air or other gases contained therein will be expelled therefrom. In accomplishing the method generally, first, a piece of vinyl is placed on the bed plate of a heat sealing press so that it is centered under the die. This piece will become panel 13 of the envelope or cell 11. Next a piece of urethane foam material 29 is centered on the vinyl, an interial divider 19 laid on top of the urethane foam and centered thereon, another piece of urethane foam material laid on the interior divider 19 and centered thereon and finally another piece of vinyl which forms panel 15 of the envelope is laid on top of the foam and then centered. The top piece of vinyl has valve 17 fused into it and the valve is in closed position. Subsequently, the heat sealing press is actuated so that the die is brought down on the assembly. The packing in the die compresses the urethane foam forcing the air or any other gases contained therein to be expelled. While the die is in the actuated position, radio frequency heating is applied in the standard way along the peripheral edges of the assembly forming a seal 31. The assembly in a compressed position is shown in FIG. 6 and sealing of the same when in a compressed state prevents the core 29 from absorbing air when the die is withdrawn. Thus, a flattened envelope or cell 11 is produced consisting of compressed core 29 in an envelope 11 which is separated into compartments 21 and 23 by interior divider 19. It is to be noted that in these cases where urethane foam is to be adhesively attached to the interior divider only, on either one or both sides thereof, or to both panels of the envelope as well, the adhesive may be applied to the panels on the side thereof which will become the internal surfaces, and to one or both sides of the divider before these elements are placed on the bed plates of the heat sealing press, or as they are "laid up" on the bed plate.

The compressed envelope or cell is submerged in fluid or liquid, preferably water, the valve 17 opened, and the fluid is permitted to enter the envelope through the valve causing expansion of the core 29 as shown in FIG. 7 until the core will absorb no more. In other words, the core is substantially saturated. Alternatively, the compressed envelope or cell may simply be filled with a pressure pump which does not allow any air to enter it. It is to be noted that the vinyl material pieces and the interior divider piece are employed in a size sufficient to accommodate the expansion of the envelope. This extra material is shown as vertical wall section 51 in FIG. 7.

Once core 29 is saturated, valve 17 is closed and the envelope is removed from the fluid or liquid, dried, and, optionally, placed within casing 49 which is made in two halves provided with a suitable cavity to receive the envelope, preferably being glued to the surfaces of the cavity. As a final step, suitable covering material may be placed around the casing, or the envelope itself in those instances where a casing is not employed.

It will be appreciated that the peripheral openings in the interior divider, such as shown at 25 and 27 in FIG. 1, as well as the aligned openings, such as shown at 33, 35, 37, 39 and 41 in FIG. 2 can be pre-cut as needed in the vinyl material forming the panels of the envelope and in the interior divider before they are assembled in the die. Moreover, the aligned openings can be sealed around their peripheries in the desired manner with respect to height simultaneously with the heat sealing of the peripheral edges of the envelope. In such instances the die can be suitably modified to accomplish such sealing in accordance with known techniques. The same is also true when tubular means are employed and in such instance the tubular means can be inserted through the aligned openings when assembling the various elements in the die which will in such cases be modified to accommodate the presence of the tubular means.

What is claimed is:

1. A damped liquid displacement support system which is substantially completely stable with respect to wave action or rolling motion of the liquid contained therein and nonsusceptible to the accumulation of a substantial amount of said liquid in a particular portion thereof when force is applied thereto, irrespective of the spatial disposition of said system, said support system comprising an envelope of flexible liquid impervious material, said envelope having two substantially parallel panels of substantially the same size, each panel having a border surface, said border surfaces of said panels being sealed together in a liquid impervious seam, one of said panels serving as a body supporting surface, a core of resilient liquid-absorbent material occupying substantially all the space within said envelope, a liquid substantially saturating said core, a valve mounted in said envelope for communication between the interior thereof and its ambience for admitting and discharging liquids and gases, and at least one interior divider substantially parallel to and the same size as each of said envelope panels and separating said envelope into at least two compartments each of which contains its own liquid-saturated core, said interior divider having a plurality of peripherally disposed openings and no other holes therethrough, said openings in the periphery of said interior divider being located and sized so as to cause said liquid to migrate between the compartments of said envelope in a controlled substantially uniform flow with substantially no wave action or rolling motion and without accumulation of a substantial amount of said liquid in a particular portion of said envelope when pressure is applied to said envelope having a force component perpendicular to said body supporting surface, irrespective of the spatial disposition of said system, whereby an individual may use said envelope as a support cushion, said liquid within said envelope gradually seeking equilibrium about that portion of the individual's body contacting said envelope.

2. A damped liquid displacement support system according to claim 1 wherein the core is a flexible cellular material.

3. A damped liquid displacement support system according to claim 1 wherein the core is cellular polyurethane.

4. A damped liquid displacement support system according to claim 1 wherein the core of resilient liquid absorbent material is adhesively attached to the interior divider and to the interior surfaces of the envelope.

5. A damped liquid displacement support system according to claim 1 wherein areas of the envelope are substantially completely compressed to reduce or remove pressure at sensitive areas on the body of an individual using the damped liquid displacement support system and provide increased floatation in the balance of the envelope.

6. A damped liquid displacemet support system according to claim 1 wherein the liquid is a fluid comprising by weight 20 percent propylene glycol, 4 percent alkali-soluble cellulose ether, and water.

7. A damped liquid displacement support system according to claim 1 including a relatively thick casing of resilient material surrounding the envelope.

8. A damped liquid displacement support system according to claim 7 wherein the casing and the envelope are adhesively attached to each other.

9. A damped liquid displacement support system which responds to changes in applied pressure in a controlled manner and which reduces or removes support pressure at sensitive areas of the body of an individual using the damped liquid displacement support system, said support system comprising an envelope of flexible liquid impervious material, said envelope having two substantially parallel panels of substantially the same size, each panel having a border surface, said border surfaces of said panels being sealed together in a liquid impervious seam, one of said panels serving as a body supporting surface, a core of resilient liquid-absorbent material occupying substantially all the space within said envelope, a liquid substantially saturating said core, a valve mounted in said envelpe for communication between the interior thereof and its ambience for admitting and discharging liquids and gases, at least one interior divider substantially parallel to and the same size as each of said envelope panels and separating said envelope into at least two compartments each of which contains its own liquid-saturated core, said interior divider having a plurality of openings disposed along the periphery of said envelope, said openings in said interior divider permitting said liquid to migrate in a throttled manner between the compartments of said envelope when pressure is applied thereto having a force component perpendicular to said body supporting surface, and a plurality of aligned openings disposed in said envelope and said interior divider, said peripheral edges of said envelope and said interior divider formed by said aligned openings being joined together in a liquid impervious seam around said openings such that areas of compression are formed within said envelope, said areas of compression being selectively positioned to reduce or remove pressure at sensitive areas on the body of an individual using the damped liquid displacement support system.

10. A damped liquid displacement support system according to claim 16 wherein the aligned openings in the interior divider are of larger dimensions than the aligned openings in the envelope and only the aligned openings of said envelope are joined together around the peripheral edges of said openings.

11. A damped liquid displacement support system according to claim 16 wherein the peripheral edges of the envelope and the interior divider formed by the aligned openings are joined together at substantially zero height with respect to each other.

12. A damped liquid displacement support system according to claim 16 wherein a tubular means is disposed in the aligned openings and the peripheral edges of the envelope and the interior divider formed by said aligned openings are joined to said tubular means at a distance spaced apart from each other.

13. A damped liquid displacement support system according to claim 16 wherein the aligned openings in the interior divider are of larger dimensions than the aligned openings in the envelope, a tubular means is disposed in the aligned openings, and only the aligned openings of said envelope are joined to said tubular means around the peripheral edges of said openings at a distance spaced apart from each other.

14. A method for making a damped fluid displacement support system comprising the steps of:

making a pattern, mold or form of an individual's body geography, impressing, locating and sizing on said pattern, mold or form areas of bony protuberances on said body, while marking on said pattern, mold or form areas of sensitivity or injury which make no impressions thereon, placing on said pattern, mold or form at least two cores of resilient liquid absorbent material within an unsealed envelope of liquid impervious material, said cores substantially filling said envelope, said envelope having two substantially parallel panels of substantially the same size, one of said panels serving as a body supporting surface, disposing at least one interior divider provided with a plurality of peripherally disposed openings across the interior of said envelope and between said cores, said interior divider being substantially parallel to and the same size as each of said envelope panels, said interior divider separating said envelpe into at least two compartments each of which contains its own core and which communicate with each other through the openings in the periphery of said interior divider, compressing said envelope and said cores and forming depressed areas or holes in said envelopes corresponding to the areas of bony protuberances and sensitivity or injury on said pattern, mold or form while expelling substantially all of the gases thereform, sealing said divider and said envelope to each other around their peripheral edges and at the depressed areas thereof, submerging the compressed envelope and cores in a liquid and partially opening the envelope to emit said liquid thereto until said cores are substantially saturated therewith and will absorb no more thereof, and closing the envelope, thereby forming a damped fluid displacement support system having depressed areas or holes conforming to the areas of bony protuberances and sensitivity or injury on said pattern, mold or form which correspond to like areas on said body, said openings in the periphery of said interior divider being located and sized so as to cause said liquid to migrate between the compartments of said envelope in a controlled substantially uniform flow with substantially no wave action or rolling motion and without accumulation of a substantial amount of said liquid in a particular portion of said envelope when pressure is applied to said envelope having a force component perpendicular to said body supporting surface, irrespective of the spatial disposition of said system, whereby an individual may use said envelope as a support cushion, said liquid within said envelope gradually seeking equilibrium about the portion of the individual's body contacting said envelope.

15. A method according to claim 14 wherein the pattern mold or form material is hardened and employed as a base for the damped fluid displacement support system, the depressions and compressed areas of which system correspond to those of said mold.

* * * * *

UNITED STATES PATENT AND TRADEMARK OFFICE

CERTIFICATE OF CORRECTION

PATENT NO. : 4,942,634

DATED : July 24, 1990

INVENTOR(S) : Saloff et al.

It is certified that error appears in the above-identified patent and that said Letters Patent is hereby corrected as shown below:

In the Claims olumn 15, line 50, substitute --envelope-- for "envelpe".
olumn 16, line 8, substitute --9-- for "16".
olumn 16, line 14, substitute --9-- for "16".
olumn 16, line 19, substitute --9-- for "16".
olumn 16, line 25, substitute --9-- for "16".
olumn 16, line 53, substitute --envelope-- for "envelpe".
olumn 16, lines 62-63, substitute --therefrom-- for "thereform".

Signed and Sealed this

Twenty-sixth Day of November, 1991

*Attest:*

HARRY F. MANBECK, JR.

*Attesting Officer*

*Commissioner of Patents and Trademarks*